US011267269B2

(12) United States Patent
Tsubaki

(10) Patent No.: US 11,267,269 B2
(45) Date of Patent: Mar. 8, 2022

(54) RECORDING-HEAD POSITION ADJUSTMENT MECHANISM, RECORDING-HEAD MODULE, AND IMAGE FORMING APPARATUS

(71) Applicant: Kengo Tsubaki, Kanagawa (JP)

(72) Inventor: Kengo Tsubaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/103,526

(22) Filed: Nov. 24, 2020

(65) Prior Publication Data

US 2021/0162784 A1 Jun. 3, 2021

(30) Foreign Application Priority Data

Nov. 28, 2019 (JP) ..... JP2019-215566
Nov. 6, 2020 (JP) ..... JP2020-185909

(51) Int. Cl.
*B41J 25/316* (2006.01)
*B41J 25/00* (2006.01)

(52) U.S. Cl.
CPC ..... *B41J 25/316* (2013.01)

(58) Field of Classification Search
CPC .... B41J 25/316; B41J 25/003; B41J 2202/21; B41J 2/2146
See application file for complete search history.

(56) References Cited

U.S. PATENT DOCUMENTS

2006/0238565 A1* 10/2006 Jung ..... B41J 25/3082 347/37
2011/0050814 A1 3/2011 Tsubaki et al.
2011/0181670 A1 7/2011 Tsubaki
2012/0062659 A1 3/2012 Tsubaki
2013/0235131 A1 9/2013 Watanabe et al.
2014/0063141 A1 3/2014 Tsubaki et al.
2014/0071201 A1* 3/2014 Liberman ..... B41J 25/003 347/38
2015/0258815 A1 9/2015 Tsubaki et al.
2016/0096377 A1 4/2016 Katoh et al.
2017/0057260 A1* 3/2017 Ueda ..... B41J 19/142
2019/0061396 A1 2/2019 Suzuki
2019/0077158 A1 3/2019 Tsubaki
2020/0208317 A1* 7/2020 Sunaoshi ..... B41J 19/202

FOREIGN PATENT DOCUMENTS

JP 2006-051621 2/2006
JP 2008-238138 10/2008
JP 2013-256077 12/2013
JP 2019-038231 3/2019
JP 2020104497 A * 7/2020 ..... B41J 19/202

* cited by examiner

*Primary Examiner* — Scott A Richmond
(74) *Attorney, Agent, or Firm* — Duft & Bornsen, PC

(57) ABSTRACT

A recording-head position adjustment mechanism adjusts a position of a recording head. The recording-head position adjustment mechanism includes a first support, a second support, and an adjuster. The first support supports a first end of the recording head in a longitudinal direction of the recording head. The second support supports a second end of the recording head in the longitudinal direction. The adjuster moves the second support with respect to the first support in a transverse direction intersecting the longitudinal direction to adjust an inclination of the recording head.

19 Claims, 4 Drawing Sheets

RECORDING-HEAD POSITION ADJUSTMENT MECHANISM, RECORDING-HEAD MODULE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-215566, filed on Nov. 28, 2019 and 2020-185909, filed on Nov. 6, 2020, in the Japan Patent Office, the entire disclosure of each of which is hereby incorporated by reference herein.

BACKGROUND

Technical Field

Embodiments of the present disclosure relate to a recording-head position adjustment mechanism to adjust a position of a recording head that discharges liquid droplets, and further relate to a recording-head module and an image forming apparatus, including the recording-head position adjustment mechanism.

Description of the Related Art

In an image forming apparatus such as an inkjet printer, a technique is widely known that adjusts the positions of recording heads (printing modules) to form a good image without positional deviation.

SUMMARY

Embodiments of the present disclosure describe an improved recording-head position adjustment mechanism that adjusts a position of a recording head. The recording-head position adjustment mechanism includes a first support, a second support, and an adjuster. The first support supports a first end of the recording head in a longitudinal direction of the recording head. The second support supports a second end of the recording head in the longitudinal direction. The adjuster moves the second support with respect to the first support in a transverse direction intersecting the longitudinal direction to adjust an inclination of the recording head.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
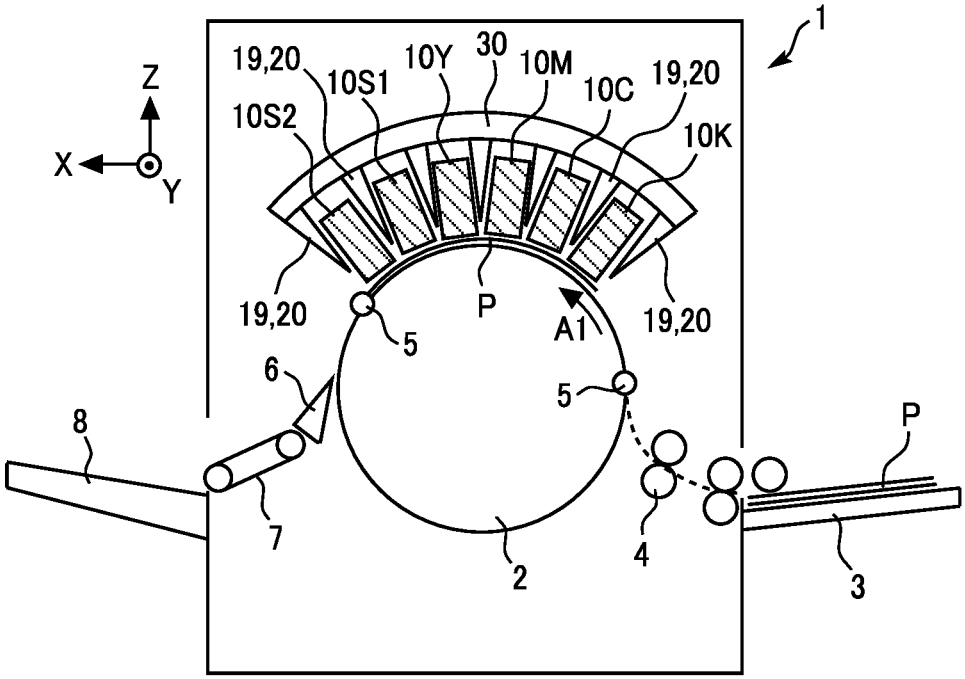
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and a description of those components is simplified or omitted as appropriate.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A comparative image forming apparatus includes recording heads (printing modules) for a plurality of colors that are arranged so as to face a sheet conveyed by a conveyor. The recording heads for the plurality of colors discharge liquid droplets toward the conveyed sheet to form a desired color image on the sheet. The comparative image forming apparatus uses a technique for adjusting the inclination of the recording head by manually rotating an adjuster to rotate a beam supporting the recording head around a support shaft.

In a recording-head position adjustment mechanism of the comparative image forming apparatus, the position (inclination) of the recording head is adjusted by swinging the beam which may be large to match the size of the recording head in the longitudinal direction. Therefore, the apparatus including the comparative recording-head position adjustment mechanism may become large, and it may take time and effort to adjust the position of the recording head. In order to solve such a situation as described above, the present disclosure has an object to provide a recording-head position adjustment mechanism, a recording-head module, and an image forming apparatus that can easily adjust the position of the recording head without increasing the size of the apparatus.

Embodiments of the present disclosure are described in detail with reference to drawings.

The configuration and operation of an image forming apparatus 1 according to the present embodiment is described below with reference to FIG. 1. In FIG. 1, the image forming apparatus 1 is illustrated as an inkjet printer. The image forming apparatus 1 includes a conveyance drum 2 serving as a conveyor to convey a sheet P, a sheet feeding tray 3 on which sheets P to be printed are stacked, and grippers 5 to grip the sheet P on the conveyance drum 2. The image forming apparatus 1 further includes a separator 6 to separate the sheet P from the conveyance drum 2, a conveyance belt 7 to convey the sheet P separated from the conveyance drum 2, and a sheet ejection tray 8 onto which the printed sheet P is ejected and stacked. The image forming apparatus 1 further includes recording heads (printing modules) 10Y, 10M, 10C, 10K, 10S1, and 10S2 serving as image forming units for printing, e.g., letters and images by an inkjet method, a supporting member to support (suspend) the recording heads 10Y, 10M, 10C, 10K, 10S1, and 10S2, and a base frame 30 to hold the supporting member. The supporting member includes a first support 19 and a second support 20.

Figure 2:
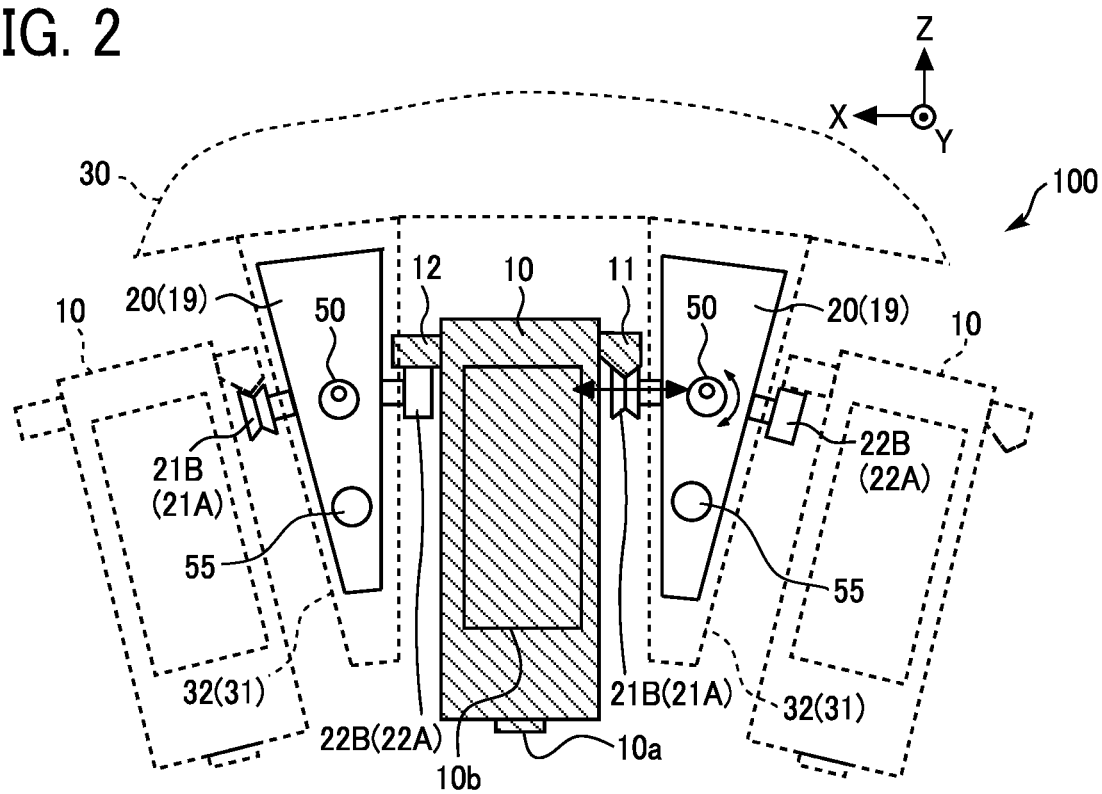
FIG. 2 is a schematic view of a recording head suspended by a supporting member according to an embodiment of the present disclosure.

The image forming apparatus 1 according to the present embodiment forms a color image. As illustrated in FIG. 1, the image forming apparatus 1 includes the recording head 10K for black, the recording heads 10Y, 10M, and 10C for three colors (yellow, magenta, and cyan), and the recording heads 10S1 and 10S2 for coating (two spot colors). The six recording heads 10Y, 10M, 10C, 10K, 10S 1, and 10S2 are opposed to the conveyance drum 2 and arranged side by side along the direction of rotation of the conveyance drum 2. Since the six recording heads 10Y, 10M, 10C, 10K, 10S1, and 10S2 have substantially the same structure except that the colors (types) of inks used for printing are different, the suffixes Y, M, C, K, S1, and S2 attached to the reference numeral of the recording head 10 are omitted in FIGS. 2 and 3. A main part of the recording head 10 includes a piezoelectric actuator, a thermal actuator, or the like, and further includes a nozzle 10*a* to discharge ink as liquid droplets and an ink tank 10*b* filled with ink as illustrated in FIG. 2, and a control board (controller).

The operation of the image forming apparatus 1 is briefly described with reference to FIG. 1. First, when a print command is input together with image data from, e.g., a personal computer to the controller of the image forming apparatus 1, the sheet P is fed from the sheet feeding tray 3 by a sheet feeding roller. The sheet P fed from the sheet feeding tray 3 is conveyed toward the conveyance drum 2 by a conveyance roller pair 4. Meanwhile, in the recording heads 10Y, 10M, 10C, 10K, 10S1, and 10S2 for the respective colors, the input image data are converted into writing data of the respective colors.

The sheet P conveyed to the conveyance drum 2 is gripped by the gripper 5 and positioned on the conveyance drum 2. The conveyance drum 2 conveys the sheet P while rotating counterclockwise. As the conveyance drum 2 rotates, the sheet P is conveyed in the direction indicated by arrow A1 in FIG. 1. The recording heads 10Y, 10M, 10C, 10K, 10S1, and 10S2 sequentially discharge inks of the respective colors as liquid droplets onto the sheet P based on the writing data. Thus, a desired image is formed on the sheet P. The sheet P, on which the desired image has been formed, is separated from the conveyance drum 2 by the separator 6. The sheet P separated from the conveyance drum 2 is conveyed by the conveyance belt 7 and ejected onto the sheet ejection tray 8.

A description is given below of a recording-head position adjustment mechanism 100 to adjust the position of the recording head 10 for discharging ink (liquid droplets) in the image forming apparatus 1 with such a configuration. As illustrated in FIGS. 2 to 4C, the image forming apparatus 1 includes the first and second supports 19 and 20 to support the recording head 10. The recording head 10 can be drawn out in a predetermined direction (i.e., +Y direction in FIGS. 2 and 3). That is, the replaceable recording head 10 is removably installed in the image forming apparatus 1 so that the recording head 10 can be drawn out from the image forming apparatus 1 in +Y direction and installed into the image forming apparatus 1 in −Y direction in FIGS. 2 and 3. When ink stored in the ink tank 10*b* is depleted, the recording head 10 is drawn out, and a new recording head 10 is installed for replacement.

Here, the recording-head position adjustment mechanism 100 includes the first support 19 and the second support 20. The first support 19 supports one end of the recording head 10 in the longitudinal direction (i.e., a first predetermined position). The second support 20 supports the other end of the recording head 10 in the longitudinal direction (i.e., a second predetermined position different from the first predetermined position). Hereinafter, the one end of the recording head 10 is referred to as a "first end", and the other end of the recording head 10 is referred to as a "second end".

Figure 3:
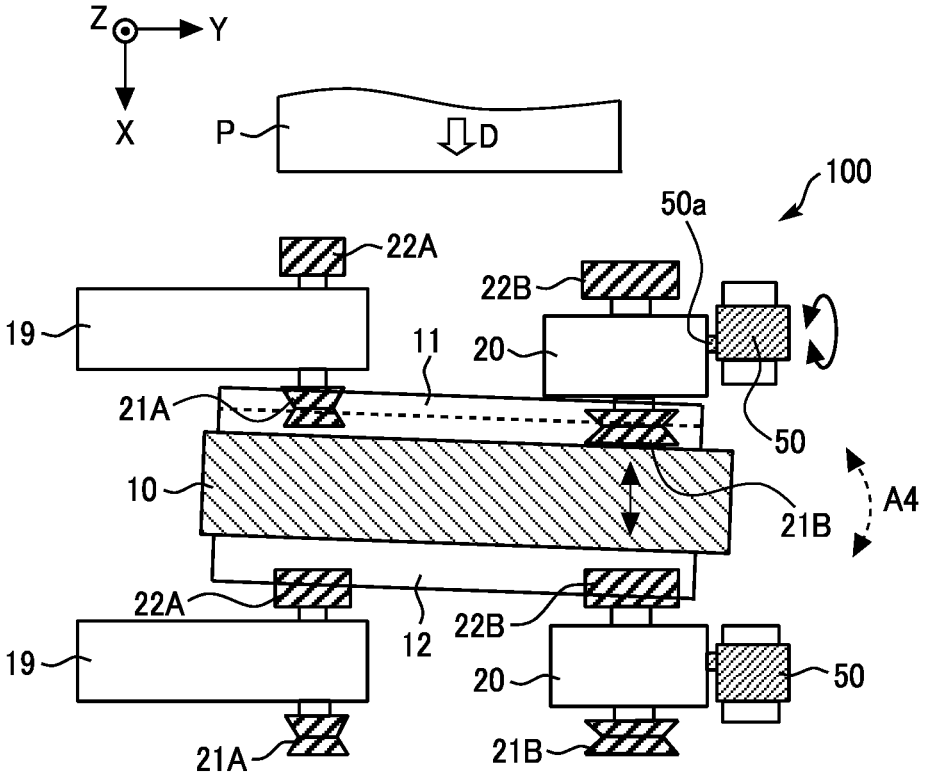
FIG. 3 is a top view of the recording head supported by a first support and a second support of the supporting member.

The recording head 10 is removably installed in the longitudinal direction (i.e., an installation direction). The longitudinal direction, which is ±Y directions, is substantially perpendicular to the direction of conveyance of the sheet P indicated by arrow D in FIG. 3. As illustrated in FIG. 3, the recording head 10 is a line head type recording head that extends in the direction substantially perpendicular to the direction of conveyance of the sheet P and includes a plurality of nozzles 10*a* over the entire width of the sheet P.

Specifically, the first and second supports 19 and 20 are arranged at the first end and the second end of the recording head 10 in the substantially horizontal direction, respectively. In the present embodiment, as illustrated in FIG. 3, the supporting member is divided into the first support 19 to support the first end of the recording head 10 in the longitudinal direction and the second support 20 to support the second end of the recording head 10 in the longitudinal direction. The first support 19 includes a first support portion at the first end and a second support portion at the first end. The second support 20 includes a first support portion at the second end and a second support portion at the second end. The pair of the first and second support portions at the first end sandwiches the first end of the recording head 10 in the longitudinal direction, and the pair of the first and second support portions at the second end sandwiches the second end of the recording head 10 in the longitudinal direction, thereby supporting the recording head 10.

As illustrated in FIG. 3, in the first support 19, a first grooved roller 21A serves as the first support portion at the first end, and a first columnar roller 22A serves as the second support portion at the first end. The first grooved roller 21A engages and supports one edge of the recording head 10 in a transverse direction of the recording head 10 at the first end in the longitudinal direction. The first columnar roller 22A supports the other edge of the recording head 10 in the transverse direction at the first end in the longitudinal direction so that the recording head 10 is movable on the first columnar roller 22A. Hereinafter, the one edge of the recording head 10 is referred to as a "first edge", and the other edge of the recording head 10 is referred to as a "second edge".

Similarly, in the second support 20, a second grooved roller 21B serves as the first support portion at the second end, and a second columnar roller 22B serves as the second support portion at the second end. The second grooved roller 21B engages and supports the first edge of the recording head 10 in the transverse direction at the second end in the longitudinal direction. The second columnar roller 22B supports the second edge of the recording head 10 in the transverse direction at the second end in the longitudinal direction so that the recording head 10 is movable on the second columnar roller 22B.

Specifically, the recording head 10 includes a ridged rail 11 as a first slider at the first edge in the transverse direction and a flat rail 12 as a second slider at the second edge in the transverse direction. The transverse direction is perpendicular to the longitudinal direction and substantially the same as the direction of conveyance of the sheet P. As illustrated in FIG. 2, the ridged rail 11 has a guide surface with a V-shaped projection, and the flat rail 12 has a flat guide surface. The ridged rail 11 and the flat rail 12 extend in the installation direction in which the recording head 10 is removably installed (i.e., ±Y directions). The first and second grooved rollers 21A and 21B have a V-shaped groove on the outer circumferential surface and are rotatably supported by the first and second supports 19 and 20. The first and second columnar rollers 22A and 22B have a flat outer circumferential surface and are rotatably supported by the first and second supports 19 and 20.

The first grooved roller 21A as the first support portion at the first end engages the ridged rail 11 as the first slider of the recording head 10. The first columnar roller 22A as the second support portion at the first end contacts the flat rail 12 as the second slider of the recording head 10. Specifically, the first grooved roller 21A is a first rotator that slidably supports the ridged rail (first slider) 11 of recording head 10 in the longitudinal direction of the recording head 10 while restricting the ridged rail 11 from moving in the transverse direction intersecting the longitudinal direction with respect to the first grooved roller 21A. The first columnar roller 22A is a second rotator that slidably supports the flat rail (second slider) 12 of the recording head 10 in the longitudinal direction of the recording head 10. Further, the first columnar roller 22A as the second rotator slidably supports the flat rail 12 in the transverse direction of the recording head 10.

Similarly, the second grooved roller 21B as the first support portion at the second end engages the ridged rail 11 of the recording head 10, and the second columnar roller 22B as the second support portion at the second end contacts the flat rail 12 of the recording head 10. Specifically, the second grooved roller 21B is a third rotator that slidably supports the ridged rail 11 of recording head 10 in the longitudinal direction of the recording head 10 while restricting the ridged rail 11 from moving in the transverse direction intersecting the longitudinal direction with respect to the second grooved roller 21B. The second columnar roller 22B is a fourth rotator that slidably supports the flat rail 12 of the recording head 10 in the longitudinal direction of the recording head 10. Further, the second columnar roller 22B as the fourth rotator slidably supports the flat rail 12 in the transverse direction of the recording head 10.

While the first and second grooved rollers 21A and 21B and the first and second columnar rollers 22A and 22B rotate, the ridged rail 11 and the flat rail 12 move on the first and second grooved rollers 21A and 21B and the first and second columnar rollers 22A and 22B. Thus, the recording head 10 is removably installed in ±Y directions. With such a configuration, the recording head 10 is removably installed in the image forming apparatus 1 while being restricted from moving in ±X directions by the first and second grooved rollers 21A and 21B having the V-shaped groove. Accordingly, the recording head 10 can be smoothly installed in and removed from the image forming apparatus 1 without damages to the recording head 10 caused by interference with other components. That is, the first and second grooved rollers 21A and 21B function not only as positioning members for the recording head 10, but also as guide members for facilitating the installation and removal operation of the recording head 10.

In the present embodiment, the first and second grooved rollers 21A and 21B have the V-shaped groove, and the ridged rail 11 has the V-shaped projection. The V-shaped projection engages the V-shaped groove, thereby restricting the recording head 10 from moving in the ±X directions. However, the shape of the groove on the first and second grooved rollers 21A and 21B and the shape of the projection of the ridged rail 11 are not limited to the V-shape but may be any other suitable shapes that meet such a function, for example, a W-shape or a shape in which three or more V shapes are arranged.

With reference to FIGS. 2 and 3, in the present embodiment, the first support 19 includes another first columnar roller 22A (or another first grooved roller 21A) disposed on the opposite side of the portion where the first grooved roller 21A (or the first columnar roller 22A) is disposed in order to support another recording head 10 adjacent to the recording head 10. Similarly, the second support 20 includes another second columnar roller 22B (or another second grooved roller 21B) disposed on the opposite side of the portion where the second grooved roller 21B (or the second columnar roller 22B) is disposed in order to support another recording head 10 adjacent to the recording head 10. With such a configuration, the plurality of the recording heads 10Y, 10M, 10C, 10K, 10S1, and 10S2 can be compactly installed in the image forming apparatus 1 along the direction of conveyance of the sheet P.

Figure 4A:
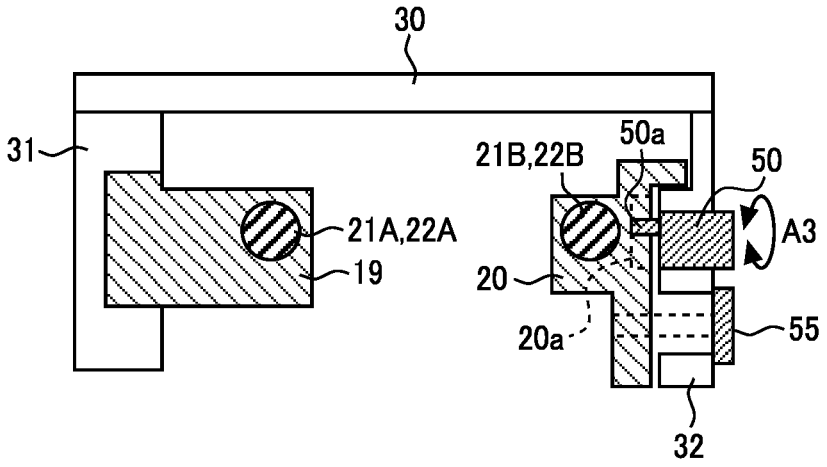
FIGS. 4A, 4B, and 4C are a side view, a front view, and a top view illustrating a part of a recording-head position adjustment mechanism according to an embodiment of the present disclosure, respectively.

As illustrated in FIG. 4A, in the present embodiment, the first support 19 is secured to a side frame 31 coupled to a base frame 30 disposed on the ceiling of the image forming apparatus 1. That is, the first support 19 is static at the secured position in the image forming apparatus 1. On the other hand, the second support 20 is slidable in the transverse direction (i.e., the direction perpendicular to the surface of the paper in which FIG. 4A is drawn and the direction indicated by arrow A2 in FIG. 4C) with respect to a side frame 32 coupled to the base frame 30. That is, the second support 20 is slidably supported in the image forming apparatus 1.

Figure 4B:
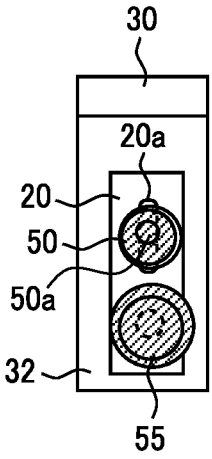
Figure 4C:
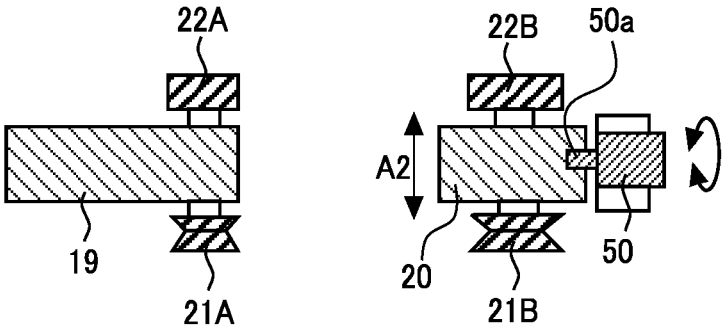

As illustrated in FIGS. 3 to 4C, the image forming apparatus 1 (the recording-head position adjustment mechanism 100) according to the present embodiment includes an adjuster 50. The adjuster 50 moves the second support 20 in the direction intersecting the longitudinal direction (i.e., the direction of conveyance of the sheet P and the transverse direction) with respect to the first support 19 to adjust the inclination of the recording head 10. Specifically, the adjuster 50 moves the second grooved roller 21B in the transverse direction intersecting the longitudinal direction. Accordingly, the first edge in the transverse direction of the recording head 10 at the second end in the longitudinal direction is moved following the movement of the second grooved roller 21B. As a result, the recording head 10 is swung around the first end in the longitudinal direction (i.e., the position of the first grooved roller 21A), thereby adjusting the inclination of the recording head 10.

More specifically, the adjuster 50 is an adjustment knob, which is rotatable, including an eccentric shaft 50*a*. The outer circumferential surface of the adjuster 50 is rotatably held by the side frame 32 (see FIGS. 4A and 4B) in the direction indicated by arrow A3. A circular hole is disposed on the side frame 32. A part of the outer circumferential surface of the adjuster 50 in the axial direction fits into the circular hole, and the eccentric shaft 50*a* secured to the adjuster 50 is held by the second support 20. A slot 20*a* that is long in the vertical direction is disposed on the second support 20. The outer circumferential surface of the eccentric shaft 50*a* of the adjuster 50 fits into the slot 20*a* and slidably contacts the slot 20*a*.

With such a configuration, as the adjuster 50 is manually rotated in the direction indicated by arrow A3 in FIG. 4A, the second support 20 slides in the direction perpendicular to the surface of the paper on which FIG. 4A is drawn (i.e., the transverse direction of the recording head 10). Accordingly, the recording head 10 is pulled by the second grooved roller 21B of the second support 20 and swung around the first end in the longitudinal direction of recording head 10 in the direction indicated by arrow A4 in FIG. 3. As a result, the inclination of the recording head 10 (i.e., squareness of recording head 10 with respect to the direction of conveyance of the sheet P) is adjusted. At this time, on the second edge of the recording head 10 in the transverse direction, the flat rail 12 slidingly moves on the first and second columnar rollers 22A and 22B. Therefore, the swing of the recording head 10 described above is not hindered. Further, for the same reason, when the recording head 10 is swung for adjustment of the inclination, the adjacent recording head 10 is not swung and the position (inclination) of the adjacent recording head 10 is not affected by the adjustment. The above-described accurate adjustment of the position (inclination) of the recording head 10 allows an excellent image to be formed on the sheet P without positional deviation.

When the inclination of the recording head 10 is adjusted as described above, the screwing of a securing member 55 illustrated in FIGS. 4A and 4B is temporarily released. The securing member 55 is screwed into the female screw portion of the second support 20 via the side frame 32, thereby securing the second support 20 to the side frame 32 of the image forming apparatus 1. Therefore, after the adjuster 50 slidingly moves the second support 20 to adjust the inclination of the recording head 10, the securing member 55 is screwed, thereby securing the second support 20 at the adjusted position.

In the present embodiment, the recording-head position adjustment mechanism 100 does not include a large support that matches the size of the recording head 10 in the longitudinal direction. As described above, in the comparative example, the recording-head position adjustment mechanism swings the large support (beam) according to the size of the recording head 10 in the longitudinal direction to adjust the position (inclination) of the recording head 10. On the other hand, in the recording-head position adjustment mechanism 100 according to the present embodiment, the supporting member is divided into the first support 19 and the second support 20 in the longitudinal direction. The adjuster 50 slidingly moves only the second support 20 while the first support 19 remains stationary, thereby adjusting the position (inclination) of the recording head 10. Therefore, the position (inclination) of the recording head 10 can be easily adjusted without increasing the size of the apparatus.

In the present embodiment, the first support 19 and the second support 20 are manufactured as separate parts, and the main body of each of the first support 19 and the second support 20 is manufactured by aluminum die casting. In particular, since the main body of the second support 20, which is the housing portion excluding the second grooved roller 21B, the second columnar roller 22B, and the like, is made of aluminum, the weight of the second support 20 is reduced, thereby facilitating the manual operation of the adjuster 50 to move the second support 20.

Further, one support (the first support 19) and the other support (the second support 20) included in the supporting member are provided with a gap in the longitudinal direction. Therefore, the supporting member can be made small as compared with the configuration including a single large support extending over the entire longitudinal direction, and the apparatus including such a supporting member can be downsized.

Further, in the present embodiment, as described above with reference to FIG. 3, the ridged rail 11 of recording head 10 engages the first and second grooved rollers 21A and 21B, and the flat rail 12 of recording head 10 is slidingly movable on the first and second columnar rollers 22A and 22B. Therefore, the above-described operation of the adjuster 50 to swing recording head 10 is not hindered, and the recording head 10 is supported by the four rollers (i.e., the first and second grooved rollers 21A and 21B, and the first and second columnar rollers 22A and 22B) in a well-balanced manner.

Further, the four rollers (i.e., the first and second grooved rollers 21A and 21B, and the first and second columnar rollers 22A and 22B) are arranged at four balanced positions, i.e., at the positions of the first edge in the transverse direction at the first end in the longitudinal direction, the second edge in the transverse direction at the first end in the longitudinal direction, the first edge in the transverse direction at the second end in the longitudinal direction, and the second edge in transverse direction at the second end in the longitudinal direction. This configuration can downsize the recording-head position adjustment mechanism 100 (image forming apparatus 1).

Figure 5A:
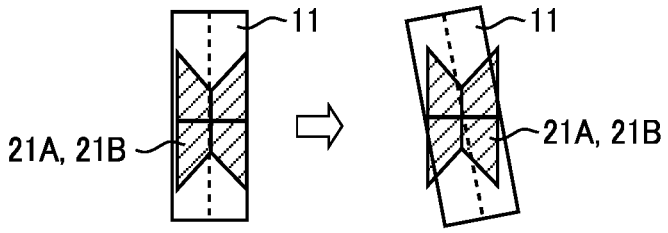
FIGS. 5A and 5B are schematic views of a grooved roller and a ridged rail of the recording head according to an embodiment of the present disclosure.
Figure 5B:
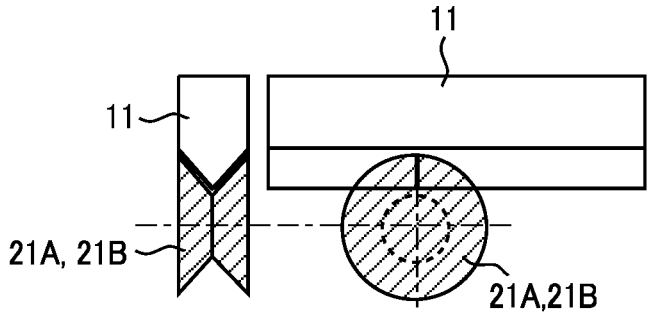

Here, the engagement of the first and second grooved rollers 21A and 21B, and the ridged rail 11 is described with reference to FIGS. 5A and 5B. The first and second grooved rollers 21A and 21B have the V-shaped groove, that is, have a shape such that the tips on the small diameter side of two cones are combined. Accordingly, as illustrated in FIGS. 5A and 5B, the first and second grooved rollers 21A and 21B are in line contact with the V-shaped projection of the ridged rail 11. Therefore, as illustrated in FIG. 5A, even when the recording head 10 is inclined with respect to the longitudinal direction and the ridged rail 11 is inclined relative to the first and second grooved rollers 21A and 21B, the line contact thereof is hardly changed. Therefore, the ridged rail 11 does not float from the first and second grooved rollers 21A and 21B. That is, regardless of the posture of the recording head 10 in the inclination direction, the recording head 10 is supported by the four rollers (i.e., the first and second grooved rollers 21A and 21B, and the first and second columnar rollers 22A and 22B) without floating.

In the present embodiment, the second support 20 and the adjuster 50 are disposed at positions corresponding to the front side in the installation direction of the recording head 10. Specifically, a door is disposed on the front side of the image forming apparatus 1 in the installation direction. With the door opened, an operator pulls out the recording head 10 through the front side or inserts the recording head 10 toward the rear side of the image forming apparatus 1 in the installation direction. The adjuster 50 is exposed to the operator when the door is opened. In the image forming apparatus 1, the second support 20 is disposed on the front side in the installation direction of the recording head 10, and the first support 19 is disposed on the rear side in the installation direction. With such a configuration, the operator can smoothly adjust the inclination of the recording head 10 by operating the adjuster 50 with the door opened.

Figure 6:
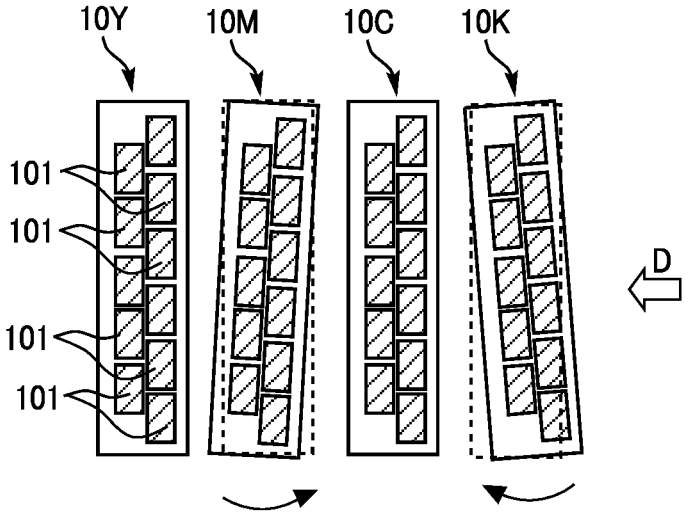
FIG. 6 is a top view illustrating the arrangement of four array-type recording heads according to a variation.

As a variation, FIG. 6 is a top view illustrating the arrangement of four array-type recording heads 10Y, 10M, 10C, and 10K in the direction of conveyance of the sheet P indicated by arrow D. In the above-described embodiment, each of the six recording heads 10Y, 10M, 10C, 10K, 10S1, and 10S2 includes a single head longer than the width of the sheet P. In the variation, the array-type recording heads 10Y, 10M, 10C, and 10K illustrated in FIG. 6 are arranged in parallel. Unlike the above-describe embodiment, each of the array-type recording heads 10Y, 10M, 10C, and 10K includes a plurality of heads 101 (11 heads in FIG. 6). The recording-head position adjustment mechanism 100 according to the above-described embodiment can be applied to the array-type recording heads 10Y, 10M, 10C, and 10K. Accordingly, the array-type recording heads 10Y, 10M, 10C, and 10K can be easily adjusted without increasing the size of the recording-head position adjustment mechanism 100 (image forming apparatus 1). In FIG. 6, among the four array-type recording heads 10Y, 10M, 10C, and 10K, the array-type recording head 10M for magenta is swung counterclockwise to adjust the inclination thereof, and the array-type recording head 10K for black is swung clockwise to adjust the inclination thereof.

As described above, according to the above embodiments, the recording-head position adjustment mechanism 100 (the image forming apparatus 1) includes the first support 19 to support the first end of the recording head 10 in the longitudinal direction and the second support 20 to support the second end of the recording head 10 in the longitudinal direction. The recording-head position adjustment mechanism 100 further includes the adjuster 50 that moves the second support 20 in the transverse direction intersecting the longitudinal direction with respect to the first support 19 to adjust the inclination of the recording head 10. With this configuration, the position (inclination) of the recording head 10 can be easily adjusted without increasing the size of the apparatus.

In the above-described embodiments, the image forming apparatus 1 includes the six recording heads 10Y, 10M, 10C, 10K, 10S1, and 10S2. However, the number of recording heads is not limited to six but may be any suitable number.

Further, in the above-described embodiments, the plurality of recording heads 10Y, 10M, 10C, 10K, 10S1 and 10S2 are arranged in a radial pattern (on a curved surface) along the outer circumferential surface of the conveyance drum 2. However, when the sheet P is conveyed on a flat conveyance surface, a plurality of recording heads can be flatly arranged side by side along the flat conveyance surface.

In such configurations, effects similar to those described above are also attained.

Further, in the above-described embodiments, the recording head 10 and the recording-head position adjustment mechanism 100 including the first and second supports 19 and 20, the base frame 30, the side frames 31 and 32 can be unitized and construct a recording-head module. In that case, the recording head module is removably installed in the image forming apparatus 1 in a single construction.

Further, in that case, an image forming apparatus may include a recording head module in which a plurality of recording-head position adjustment mechanisms and a plurality of recording heads 10Y, 10M, 10C, 10K, 10S1 and 10S2 are unitized.

In such configurations, effects similar to those described above are also attained.

As described above, according to the present disclosure, a recording-head position adjustment mechanism, a recording-head module, and an image forming apparatus can be provided that can easily adjust the position of the recording head without increasing the size of the apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A recording-head position adjustment mechanism configured to adjust a position of a recording head, the recording-head position adjustment mechanism comprising:

a first support configured to support a first end of the recording head in a longitudinal direction of the recording head while a second end of the recording head remains separate from the first support;

a second support configured to support the second end of the recording head, distinct from the first end of the recording head, in the longitudinal direction; and an adjuster configured to move the second support with respect to the first support in a transverse direction intersecting the longitudinal direction to adjust an inclination of the recording head.

2. The recording-head position adjustment mechanism according to claim 1, wherein the first support is static, wherein the second support includes:

a first support portion at the second end configured to support a first edge of the recording head in the transverse direction at the second end in the longitudinal direction; and a second support portion at the second end configured to support a second edge of the recording head in the transverse direction at the second end in the longitudinal direction, and wherein the adjuster is configured to move the first support portion at the second end in the transverse direction to cause the first edge of the recording head in the transverse direction at the second end in the longitudinal direction to move following the first support portion at the second end and to cause the recording head to swing around the first end in the longitudinal direction to adjust the inclination of the recording head.

3. The recording-head position adjustment mechanism according to claim 2, wherein the first support includes:

a first support portion at the first end configured to support the first edge of the recording head in the transverse direction at the first end in the longitudinal direction; and a second support portion at the first end configured to support the second edge of the recording head in the transverse direction at the first end in the longitudinal direction.

4. The recording-head position adjustment mechanism according to claim 3, wherein the first support portion at the first end is a first rotator configured to slidably support a first slider of the recording head in the longitudinal direction while restricting the first slider from moving in the transverse direction with respect to the first rotator, wherein the second support portion at the first end is a second rotator configured to slidably support a second slider of the recording head in the longitudinal direction, wherein the first support portion at the second end is a third rotator configured to slidably support the first slider in the longitudinal direction while restricting the first slider from moving in the transverse direction with respect to the third rotator, and wherein the second support portion at the second end is a fourth rotator configured to slidably support the second slider in the longitudinal direction.

5. The recording-head position adjustment mechanism according to claim 4, wherein the second rotator is configured to slidably support the second slider in the transverse direction, and wherein the fourth rotator is configured to slidably support the second slider in the transverse direction.

6. The recording-head position adjustment mechanism according to claim 3, wherein the first support includes another second support portion at the first end located on an opposite side of a portion where the first support portion at the first end is located, to support another recording head adjacent to the recording head, and wherein the second support includes another second support portion at the second end located on an opposite side of a portion where the first support portion at the second end is located, to support another recording head adjacent to the recording head.

7. The recording-head position adjustment mechanism according to claim 3, wherein the first support includes another first support portion at the first end located on an opposite side of a portion where the second support portion at the first end is located, to support another recording head adjacent to the recording head, and wherein the second support includes another first support portion at the second end located on an opposite side of a portion where the second support portion at the second end is located, to support another recording head adjacent to the recording head.

8. The recording-head position adjustment mechanism according to claim 1, wherein the longitudinal direction is an installation direction in which the recording head is removably installed in the recording-head position adjustment mechanism, and the transverse direction is a direction in which a sheet is conveyed, and wherein the second support and the adjuster are arranged on a front side in the installation direction.

9. A recording-head module comprising:

a recording head configured to discharge liquid droplets; and the recording-head position adjustment mechanism according to claim 1, wherein the recording head and the recording-head position adjustment mechanism are unitized.

10. The recording-head module according to claim 9, wherein the recording head includes a plurality of recording head, and wherein the recording-head position adjustment mechanism include a plurality of recording-head position adjustment mechanisms.

11. An image forming apparatus comprising:

a recording head configured to discharge liquid droplets on a sheet;

the recording-head position adjustment mechanism according to claim 1; and a conveyor configured to convey the sheet to the recording head.

12. A recording-head position adjustment mechanism configured to adjust a position of a recording head, the recording-head position adjustment mechanism comprising:

a first support that is static and is configured to support a first end of the recording head in a longitudinal direction of the recording head while a second end of the recording head remains separate from the first support, the first support including:

a first support portion at the first end configured to support a first edge of the recording head in a transverse direction at the first end in the longitudinal direction; and a second support portion at the first end configured to support a second edge of the recording head in the transverse direction at the first end in the longitudinal direction, a second support configured to support the second end of the recording head, distinct from the first end of the recording head, in the longitudinal direction, the second support including:

a first support portion at the second end configured to support the first edge of the recording head in the transverse direction at the second end in the longitudinal direction; and a second support portion at the second end configured to support the second edge of the recording head in the transverse direction at the second end in the longitudinal direction, and an adjuster configured to move the second support with respect to the first support in the transverse direction intersecting the longitudinal direction to adjust an inclination of the recording head, wherein the adjuster is configured to move the first support portion at the second end in the transverse direction to cause the first edge of the recording head in the transverse direction at the second end in the longitudinal direction to move following the first support portion at the second end and to cause the recording head to swing around the first end in the longitudinal direction to adjust the inclination of the recording head, wherein the first support portion at the first end is a first rotator configured to slidably support a first slider of the recording head in the longitudinal direction while restricting the first slider from moving in the transverse direction with respect to the first rotator, wherein the second support portion at the first end is a second rotator configured to slidably support a second slider of the recording head in the longitudinal direction, wherein the first support portion at the second end is a third rotator configured to slidably support the first slider in the longitudinal direction while restricting the first slider from moving in the transverse direction with respect to the third rotator, and wherein the second support portion at the second end is a fourth rotator configured to slidably support the second slider in the longitudinal direction.

13. The recording-head position adjustment mechanism according to claim 12, wherein the second rotator is configured to slidably support the second slider in the transverse direction, and wherein the fourth rotator is configured to slidably support the second slider in the transverse direction.

14. A recording-head position adjustment mechanism configured to adjust a position of a recording head, the recording-head position adjustment mechanism comprising:

a first support configured to support a first end of the recording head in a longitudinal direction of the recording head while a second end of the recording head remains separate from the first support, wherein the longitudinal direction is an installation direction in which the recording head is removably installed in the recording-head position adjustment mechanism, and a transverse direction is a direction in which a sheet is conveyed;

a second support configured to support the second end of the recording head, distinct from the first end of the recording head, in the longitudinal direction; and an adjuster configured to move the second support with respect to the first support in a transverse direction intersecting the longitudinal direction to adjust an inclination of the recording head, wherein the second support and the adjuster are arranged on a front side in the installation direction.

15. The recording-head position adjustment mechanism according to claim 14, wherein the first support is static, wherein the second support includes:

a first support portion at the second end configured to support a first edge of the recording head in the transverse direction at the second end in the longitudinal direction; and a second support portion at the second end configured to support a second edge of the recording head in the transverse direction at the second end in the longitudinal direction, and wherein the adjuster is configured to move the first support portion at the second end in the transverse direction to cause the first edge of the recording head in the transverse direction at the second end in the longitudinal direction to move following the first support portion at the second end and to cause the recording head to swing around the first end in the longitudinal direction to adjust the inclination of the recording head.

16. The recording-head position adjustment mechanism according to claim 15, wherein the first support includes:

a first support portion at the first end configured to support the first edge of the recording head in the transverse direction at the first end in the longitudinal direction; and a second support portion at the first end configured to support the second edge of the recording head in the transverse direction at the first end in the longitudinal direction.

17. The recording-head position adjustment mechanism according to claim 16, wherein the first support includes another second support portion at the first end located on an opposite side of a portion where the first support portion at the first end is located, to support another recording head adjacent to the recording head, and wherein the second support includes another second support portion at the second end located on an opposite side of a portion where the first support portion at the second end is located, to support another recording head adjacent to the recording head.

18. The recording-head position adjustment mechanism according to claim 16, wherein the first support includes another first support portion at the first end located on an opposite side of a portion where the second support portion at the first end is located, to support another recording head adjacent to the recording head, and wherein the second support includes another first support portion at the second end located on an opposite side of a portion where the second support portion at the second end is located, to support another recording head adjacent to the recording head.

19. An image forming apparatus comprising:

a recording head configured to discharge liquid droplets on a sheet;

the recording-head position adjustment mechanism according to claim 14; and a conveyor configured to convey the sheet to the recording head.

* * * * *